United States Patent [19]

Partington

[11] 4,420,677

[45] Dec. 13, 1983

[54] HEATING SYSTEM

[76] Inventor: Everett J. Partington, 620 South Elizabeth; Oconomowoc, Wis. 53066

[21] Appl. No.: 308,114

[22] Filed: Oct. 2, 1981

Related U.S. Application Data

[63] Continuation of Ser. No. 64,112, Aug. 6, 1979, abandoned.

[51] Int. Cl.[3] ..... H05B 1/02; F24H 7/00

[52] U.S. Cl. ..... 219/341; 219/493; 219/328; 219/365; 237/8 A; 237/59; 126/101

[58] Field of Search ..... 219/328, 331, 326, 365, 219/501, 492, 497, 296, 499, 34, 493, 338, 494; 65/10, 32, 107 R, 106; 236/1 E; 126/101; 237/7, 8 R, 8 A, 8 B, 59, 63

[56] References Cited

U.S. PATENT DOCUMENTS

| | | | |
|---|---|---|---|
| 1,906,144 | 4/1933 | Evans | 219/338 |
| 3,227,275 | 10/1966 | Brusven | 219/365 |
| 3,375,347 | 3/1968 | Seney | 219/501 |
| 3,523,182 | 8/1970 | Phillips et al. | 219/501 |
| 3,894,213 | 7/1975 | Agarwala | 219/326 |

*Primary Examiner*—M. H. Paschall

*Attorney, Agent, or Firm*—Andrus, Sceales, Starke & Sawall

[57] ABSTRACT

A heating system comprising a closed conduit containing a liquid which is continuously circulated through the conduit by a pump. An electrical resistance heating unit serves to heat the liquid in the conduit and heat is transferred from the liquid through a heat exchanger to a medium to be heated. A proportional timer is operably connected in the electrical circuit with the heating unit. The timer has a cycle of fixed duration composed of an "on" interval and an "off" interval, with the duration of the "on" interval being variable within the cycle. A temperature sensor senses the temperature of the liquid in the conduit and if the temperture falls below a set value, the sensor acts to operate the timer and energize the heating unit. A second temperature sensor acts to adjust the "on" interval of the timing cycle in proportion to the deviation of the liquid temperature from the temperature setting.

5 Claims, 5 Drawing Figures

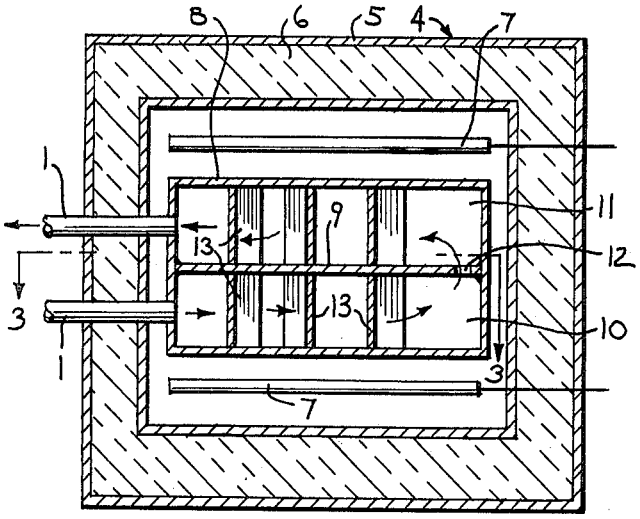
fig. 2
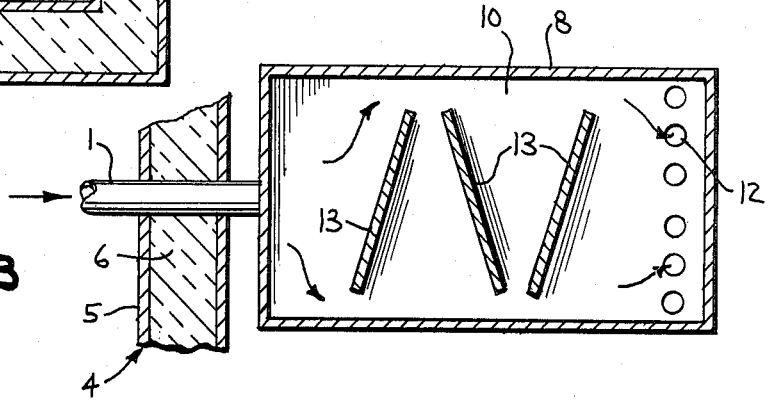
fig. 3
fig. 5
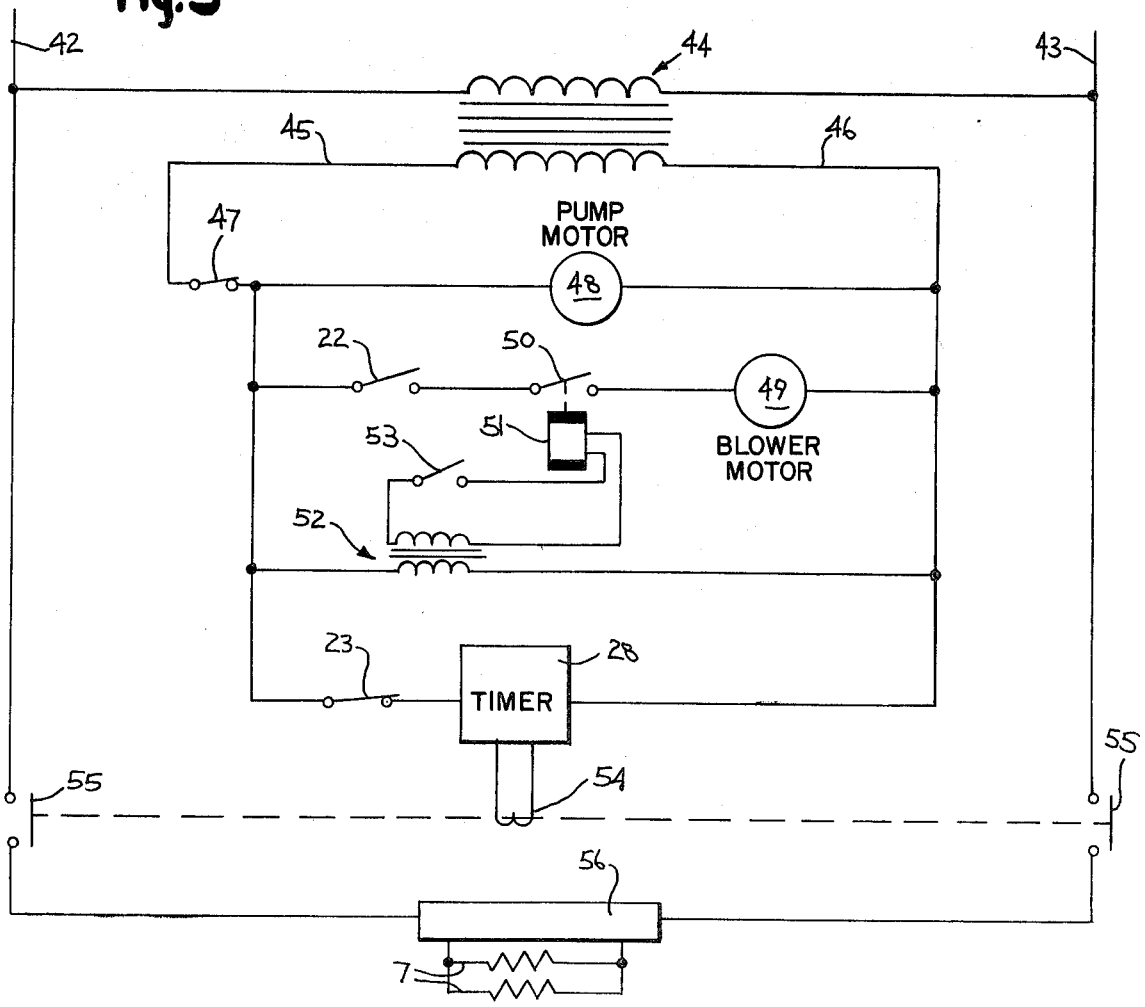

HEATING SYSTEM

This application is a continuation of application Ser. No. 06/064,112, now abandoned filed Aug. 6, 1979.

BACKGROUND OF THE INVENTION

The conventional hot air heating system, as used in a residence or commercial establishment, includes a gas or oil fired furnace which is controlled by a room thermostat. When the thermostat calls for heat, the furnace is operated, and when the plenum temperature reaches a preset value of about 200° F, the blower is operated to deliver the heated air through the duct system to the area or zone to be heated.

The conventional hot air heating system operates from a cold condition, meaning that the plenum and ducts are cold when the furnace is started up, with the result that the plenum must be initially heated before the blower is operated to deliver heat to the zone of the building, and a substantial amount of heat is lost due to the heating of the duct system.

In addition, there is substantial heat loss through the chimney in the conventional hot air heating system, due to stack heat being dissipated to the atmosphere and by virtue of natural convection of room heat through the chimney when the furnace is not operating.

Furthermore, the heating unit, as used in the conventional hot air heating system, operates at full capacity whenever the room thermostat calls for heat. This results in the room temperature going above the set temperature, and when the heating unit is de-energized, the room temperature falls beneath the set temperature before the heating unit is again energized. The result is that the room temperature oscillates or hunts about the temperature setting.

Condition response controllers, as described in U.S. Pat. No. 3,509,322, have been utilized to control the "on" time of the heating unit in accordance with the existing temperature condition. In a system such as that, the heating unit is energized at substantially full capacity when the room temperature is substantially below the desired temperature level and as the room temperature approaches the set point, the energization of the heating unit is reduced.

Periodic timing devices have also been used in conjunction with electric resistance heating units for heating food products, as disclosed in U.S. Pat. No. 3,666,921. In devices of that type, pulsations of heat are produced, and the duration of the heating pulse is controlled by the timer so that a predetermined amount of heat can be precisely programmed.

SUMMARY OF THE INVENTION

The invention relates to a heating system having improved efficiency over conventional heating systems. The heating system includes a closed conduit containing a liquid, such as water, which is continuously circulated through the conduit by a pump. The liquid in the conduit is heated by an electrical resistance heating unit through a pulse type of heating, and heat is transferred from the liquid to a medium to be heated through a heat exchange unit.

A proportional timer is operably connected to the resistance heating means and has a cycle of fixed duration. The cycle includes an "on" interval and an "off" interval and the duration of the "on" and "off" intervals can be varied within the fixed cycle.

A temperator sensor senses the temperature of the liquid in the conduit and if the temperature falls below a set value, the sensor actuates the timer to energize the heating unit. A second sensor, which is responsive to the temperature of the liquid in the conduit, is operably connected to the timer in a manner such that the "on" interval will be proportional to the deviation of the liquid temperature from the temperature setting, meaning that if the temperature of the liquid is only slightly below the temperature setting, the "on" interval will comprise only a small proportion of the timing cycle. On the other hand, if the temperature of the liquid is substantially below the temperature setting, the duration of the "on" interval will be increased.

As a feature of the invention, a frequency booster is connected in the electrical circuit with the heating unit and increases the frequently from the normal value of 60 cycles to about 80 cycles which increases the penetration and effectiveness of the pulsed heating operation.

As utilized with a hot air heating system, the heat exchange unit is located in the plenum of the hot air duct system and when the room termostat calls for heat, the blower is operated to pass air over the heat exchanger and through the duct system to the area to be heated. As the heated liquid is continuously circulated through the heat exchanger, natural convection will cause heated air to continuously flow through the duct system, even when the room thermostat is not calling for heat and the blower is not operating. This results in the duct system being warm at all times so it is not necessary to heat the entire duct system each time that the room thermostat calls for heat.

In normal operation, if the liquid temperature falls beneath the set value, the heating unit is operated through the proportional timer for a very short interval to restore the liquid temperature at the setting.

The heating unit is small and compact and has particular application for use in residences, mobile homes, prefabricated homes, and the like. As gas or oil is not required as the energy source, there is no need for a chimney or flue. As electrical energy is used as the heat source, the unit is safe and reliable.

Other objects and advantages will appear in the course of the following description.

DESCRIPTION OF THE DRAWINGS

The drawings illustrate the best mode presently contemplated of carrying out the invention.

In the drawings:

FIG. 2 is an enlarged sectional view of the resistance heating unit;

FIG. 3 is a section taken along line 3—3 of FIG. 2, showing the heating unit;

FIG. 5 is a wiring diagram of the system.

DESCRIPTION OF THE PREFERRED EMBODIMENT

Figure 1:
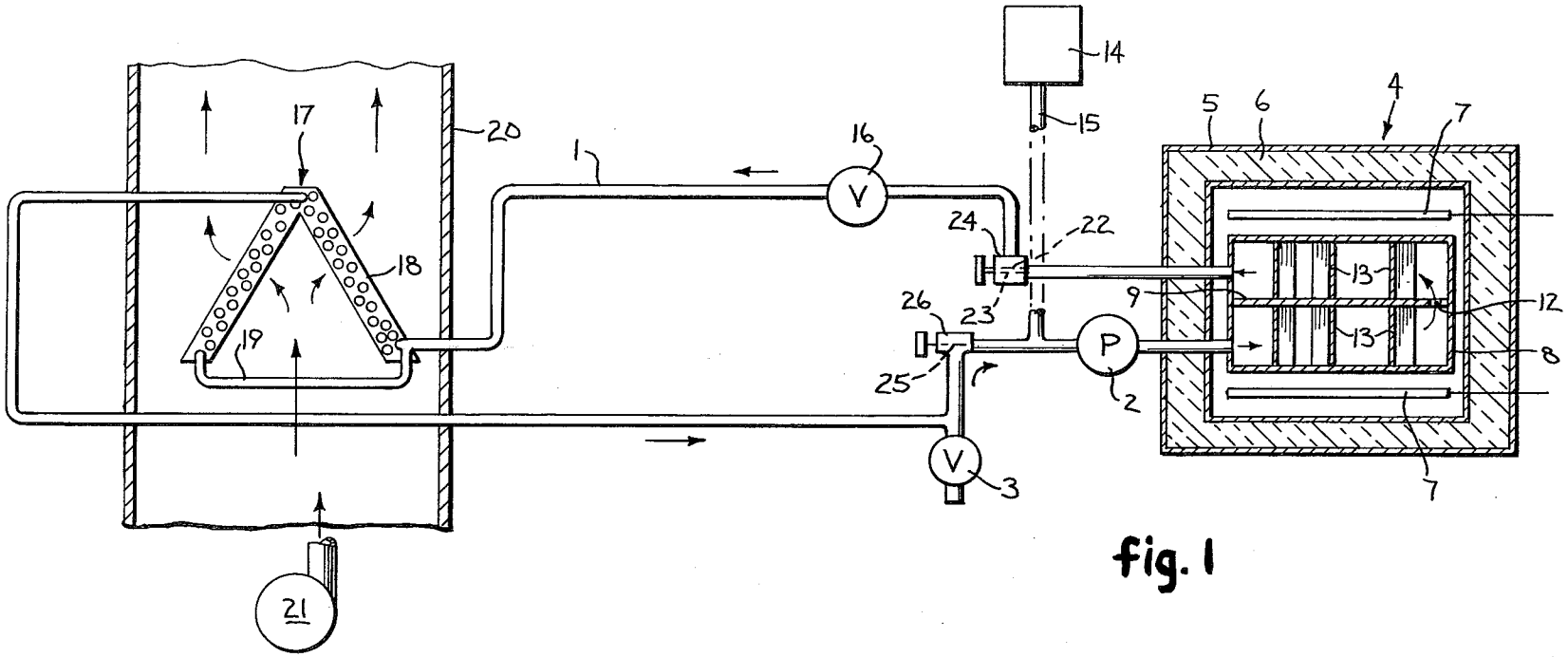
FIG. 1 is a schematic view of the heating system of the invention.

FIG. 1 is a schematic representation showing the heating system of the invention. The system includes a closed circuit 1 through which a liquid is continuously circulated by a pump 2. The liquid can be water, or a mixture of water and ethylene glycol. The mixture of water and ehtylene glycol is preferred because it has a higher boiling point than water and has better heat transfer properties. A drain valve 3 is located in the conduit 1 to drain the liquid, if desired.

To heat the liquid, a heating unit indicated generally by 4, is utilized. The heating unit 4 includes an outer metal housing or casing 5 having a thick layer of heat insulating material 6 on its inner surface. A pair of high resistance heating elements 7, which can take the form of rods, wires, foil, or the like, are located within the housing 5 in spaced relation to a metal jacket 8 which is connected in the conduit 1, so that the liquid can be circulated through the jacket.

A central wall 9 divides the jacket 8 into a pair of chambers 10 and 11 and a series of openings 12 provide communication between the two chambers. Baffles 13 can be mounted within both of the chambers 10 and 11 to provide a tortuous path for the flow of liquid through the jacket. As shown in FIG. 1, the liquid enters the chamber 10 and then passes through the openings 12 into the chamber 11 and is thereafter discharged from the jacket. The resistance heating elements 7, are spaced from the jacket and as the elements are intermittently energized or pulsed, black light heating is obtained. As an example, the spacing between the resistance heating elements 7 and the jacket 8 can be in the range of about 1.5 to 3.5 inches when utilizing a heating element generating between 2500 and 3000 watts.

An expansion tank 14 can be connected to the conduit 1 through a pipe 15, and in addition, a standard pressure relief valve 16 can also be connected in the conduit which will open the line in the event the pressure in the system exceeds a predetermined maximum level.

The invention, as illustrated in the drawings, is applied to a hot air heating system and heat is transferred from the liquid within the conduit 1 to the air through a heat exchange unit, indicated generally by 17. The specific construction of the heat exchange unit is not critical and, as shown, the unit can comprise an A-coil 18 which is connected in the conduit 1. As shown in FIG. 1, a conduit 19 is connected between the bottom portions of the legs of the coil 18 and the heated liquid flows through the tubing in both of the legs and is discharged from the apex of the coil. The A-coil 18 is contained within a plenum 20 of the hot air duct system, and air is directed over the A-coil by a blower or fan 21. The heated air then flows through the duct system to the various rooms or zones of the building to be heated.

A low temperature sensor 22 and a high temperature sensor 23 are mounted within a well 24 connected to the conduit 1 and the function of the sensors 22 and 23 will be described in detail hereinafter. In addition, a temperature sensor 25 is located in the well 26 in conduit 1, and the snesor 25 operates through a mechanical linkage, indicated generally by 27, to actuate a proportional timer 28 which is operably connected to the resistance heating element 7.

Figure 4:
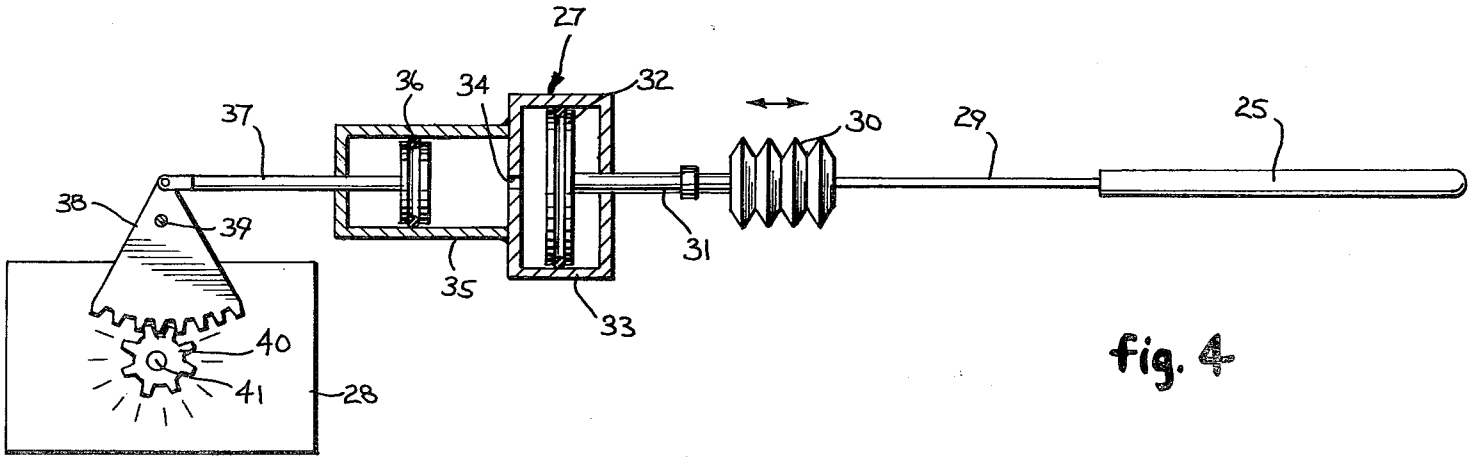
FIG. 4 is an enlarged schematic representation of the connection of the temperature sensor to the timer.

FIG. 4 illustrates the connection of the sensor 25 to the timer 28. The sensor 25 can take the form of a capillary heat bulb which is connected by a tube 29 to one end of a bellows 30. The opposite end of the bellows 30 carries a shaft which is operably engaged with a piston rod 31 attached to the piston 32 which is slidable within cylinder 33. The closed end of the cylinder 33 is provided with an opening 34 which establishes communication between the cylinder 33 and the interior of a smaller diameter cylinder 35. Piston 36 is slidable within cylinder 35 and piston rod 37 is connected to one end of a gear segment 38 which is mounted for rotation on a pivot 39. The gear segment meshes with a pinion 40 attached to the shaft 41 of the timer 28.

Variations in temperature in the liquid flowing within the conduit 1 will cause expansion and contraction of the liquid within the capillary heat bulb 29 to expand and contract the bellows 30. Expansion and contraction of the bellows operates through the cylinders 33 and 35 to rotate the gear segment 38 and thus rotate the shaft 41 on the timer to thereby vary the duration of the "on" and "off" intervals in the fixed cycle of the timer. The use of the two cylinders 33 and 35 provide a longer stroke, and thus a greater arc of rotation for the gear segment 38, for a given linear expansion of the bellows 30.

The proportional timer 28 is of conventional construction, Model HQ9001A5-J78, Eagle Signal Co. Baraboo, Wis., and has a cycle of fixed duration, as for example, 15 seconds, and having an "on" interval and an "off" interval. Within the fixed cycle, the duration of the "on" interval and the "off" interval can be varied by rotation of the shaft 41. When the temperature of the liquid is only slightly below the temperature setting of sensor 25, only a short linear movement of bellows 30 occurs, and a corresponding small degree of rotation of gear segment 38 and shaft 41 results, to thereby slightly increase the "on" interval of the timer and the heating pulse. When the temperature of the liquid is substantially below the setting of sensor 25, as for example during start-up of the system, a longer linear movement of the bellows occurs which operates through gear segment 38 and shaft 41 to produce an "on" interval and heating pulse of greater duration. Thus, the proportional timer acts to vary the "on" interval and the heating pulse in direct proportion to the difference between the temperature of the liquid and the temperature setting, i.e. the greater the difference, the longer the duration of the heating pulse within the fixed timer cycle.

The sensor 25 and mechanical linkage is designed so that if the liquid temperature is at least about 140° F or below the "on" interval will be at a maximum, while if the liquid temperature is at about 180° F or above, the "on" interval will be a minimum.

The wiring diagram is shown in FIG. 5, and the single phase, 220 volt power lines 42 and 43 are connected to the primary side of a transformer 44 and the 110 volt output side of the transformer is connected to lines 45 and 46. A manual on-off switch 47 is located in the line 45 and the motor 48 of pump 2 is connected across the lines 45 and 46. With the manual switch 47 closed, the pump 2 will operate continuously to circulate liquid through the conduit.

A motor 49 of blower 21 is connected across the 110 volt power lines 45 and 46 in series with the low temperature limit switch 22 and the contacts 50 of a relay 51. The relay 51 is connected to the 24 volt output side of a transformer 52 in series with room temperature thermostat 53, while the input or primary side of the transformer is connected to the 110 volt lines 45 and 46.

The limit switch 22 is normally set to close when the temperature of the liquid in conduit 1 reaches approximately 120° F. With switch 22 closed, the blower 21 will operate, providing that the room thermostate 53 is calling for heat and the relay contacts 50 are closed.

The high temperature limit switch 23 is connected in series across the lines 45 and 46 with the proportional timer 28. The switch 23 is normally set to open at an elevated temperature of about 190° F and on cooling of the liquid in conduit 1 from 190° F, will close at a temperature of about 180° F.

The timer is operably connected to a solenoid 54 which, when energized, operates to close the contacts 55 in the lines 42 and 43.

To increase the frequency from the normal 60 cycles to a range of about 75 to 80 cycles, a frequency changer 56 is connected across the lines 42 and 43 and the output side of the frequency changer is connected to the resistance heating elements 7.

While the wiring diagram shows a pair of resistance heating elements 7 there may be any number, depending upon the nature and capacity of the heating system.

To begin operation of the system, the on-off switch 47 is closed, which will operate the pump 2 to circulate water through the system. As the high temperature limit switch 23 is closed at this time, the proportional timer 28 will be energized to actuate the solenoid 54 and close the contacts 55 and energize the heating elements 7. As the temperature of the water at start-up will be well below 140° F, sensor 25 will adjust the "on" interval of the timer, so that it is of maximum duration.

At start-up, the temperature of the liquid will be below the setting of the low temperature limit switch 22 so that switch 22 is open and the blower 21 will not operate even if the room thermostat 53 is calling for heat. When the temperature reaches approximately 120° F, the switch 22 will close, and if the room thermostat 53 is then calling for heat, the blower 21 will operate to pass air over the heat exchanger 17 and deliver the heated air through the duct system to the room or zone to be heated.

As the temperature of the water circulating within the conduit is increased above 140° F, the sensor 25 will operate to progressively reduce the duration of the "on" interval.

When the temperature reaches the "cut-off" setting of the switch 23, which is about 190° F, the switch will open to shut off the power to the heating elements 7, but the pump 2 will continue to operate and circulate water through the conduit. If the room thermostat 53 is not calling for heat at this time, natural convection of air over the heat exchanger 17 will deliver heated air by convection through the duct system to the room to be heated and thus maintain the plenum and the duct system at a warm temperature.

In this "free wheeling" condition, when the temperature of the liquid in the conduit drops to approximately 180° F, the switch 23, will close to energize the heating elements 7, but the blower 21 will not operate unless the room thermostat 53 is calling for heat. With the liquid temperature at 180° F, the sensor 25 will operate to set the "on" interval of the timer 28 at a very minimum value. When the temperature is restored to the 190° F level, the switch 23 will open to shut off the supply of power to the heating elements 7.

If the room thermostat 53 calls for heat, the blower 21 will operate to direct air over the heat exchanger 17 and heat will be rapidly dissipated from the liquid. When the temperature falls to 180° F, the switch 23 will close to energize the heating elements 7 and if the heat loss is great, the sensor 25 will increase the duration of the "on" interval. As the temperature of the liquid again rises, the duration of "on" interval will be correspondingly decreased.

In normal operation, the temperature of the liquid will never fall to a value below about 140° F, and at this liquid temperature the "on" interval would be at its maximum duration, where the "off" interval would be only momentary.

The heating system of the invention is an efficient system, in that the pulse of power supplied to heat the liquid will be proportional to the deviation between the liquid temperature and the set temperature, meaning that if the liquid temperature is only slightly below the temperature setting, only a small amount of power will be supplied to the liquid in order to restore its temperature to the setting.

As used with a hot air heating system, the heated liquid is continuously circulated through the heat exchanger, and natural convection will cause heated air to continuously flow through the duct system, even when the room thermostat is not calling for heat and the blower is not operating. This results in the duct system being warm at all times, so it is not necessary to heat the entire duct system from a cold condition each time the room thermostat calls for heat.

Furthermore, as the system utilizes electrical energy, there is no need for a chimney or a flue and this reduces the normal heat losses which occur with a chimney due to stack heat being dissipated to the atmosphere and the natural convection of room heat through the chimney during periods when the furnace is not operating.

While the drawings and description have shown the heating system as associated with a hot air system for space heating, it is contemplated that the invention can be used with a hot water system in which the heated liquid is circulated directly t the space or zone to be heated. Moreover, the invention can be used in other heating application, which require precise temperature control, efficiently delivered, such as heating a die or mold, heating a liquid bath, and the like.

Various modes of carrying out the invention are contemplated as being within the scope of the following claims particularly pointing out and distinctly claiming the subject matter which is regarded as the invention.

I claim:

1. A heating system, comprising a closed conduit to contain a liquid, a portion of said conduit constituting a heating chamber, pumping means disposed in the conduit to continuously circulate the liquid through the conduit, a resistance heating unit spaced out of contact with the chamber to heat the liquid in the chamber, heat exchange means disposed in the conduit for transferring heat to air passing over said heat exchange means, proportional timer means operably connected to the heating unit for continuously operating said heating means in cycles of uniform duration, each cycle composed of an "on" interval in which the heating unit is energized and an "off" interval in which the heating unit is deenergized to thereby provide a pulsed heating output, the duration of the "on" and "off" intervals within the cycle each being selectively variable throughout substantially the entire duration of said cycle, temperature sensing means responsive to the temperature of the liquid upstream of the heating chamber and operably connected to said timer means to vary the duration of the "on" interval of said cycle in proportion to the deviation of the liquid temperature from a predetermined set temperature, a duct system connected to a zone to be heated, said heat exchange means disposed within said duct system, a blower disposed in said duct system and disposed to direct air across said heat exchange means and through said duct system, and a thermostat disposed in the zone to be heated and operably connected to said blower, said thermostat means being operable to actuate the blower when the temperature in said zone falls beneath a predetermined value.

2. The heating system of claim 1, wherein said cycle has a duration of about 15 seconds.

3. The heating system of claim 1, and including a metal jacket disposed in said conduit and defining said heating chamber, said resistance heating unit being spaced out of contact with said metallic jacket, and a heat insulating material enclosing the jacket and the resistance heating means.

4. The heating system of claim 1, wherein said resistance heating means comprises a resistance heating element capable of generating an output in the range of 2500 to 3000 watts, said element being spaced a distance of 1.5 to 3.0 inches from said heating chamber.

5. A heating system, comprising a closed conduit to contain a liquid, a portion of said conduit constituting a heating chamber, pumping means disposed in the conduit to continuously circulate the liquid through the conduit, resistance heating means spaced out of contact with the chamber to heat the liquid in the chamber, heat exchange means disposed in the conduit for transferring heat to a fluid passing over said heat exchange means, operating means operably connected to the heating means to energize the heating means when the temperature of said liquid falls below a pre-set value in a successive series of "on-off" heating pulses of uniform and fixed duration, each pulse being composed of an "on" interval in which the heating unit is energized and an "off" interval in which the heating unit is deenergized, the duration of said "on" and "off" intervals within a pulse each being selectively variable throughout substantially the entire duration of said pulse, and temperature sensing means operably connected to said operating means and responsive to a difference in temperature of the liquid and said preset value for varying the duration of the "on" interval in each pulse, the duration of the "on" interval decreasing as the temperature of the liquid approaches the set value and the duration of the "on" interval increasing as the temperature digresses from said set value.

* * * * *

UNITED STATES PATENT AND TRADEMARK OFFICE

CERTIFICATE OF CORRECTION

PATENT NO. : 4,420,677

DATED : December 13, 1983

INVENTOR(S) : EVERETT J. PARTINGTON

It is certified that error appears in the above-identified patent and that said Letters Patent is hereby corrected as shown below:

Col. 6, line 49, CLAIM 1 Cancel "means"; Col. 6, Line 68, CLAIM 1, Cancel "means"; Col. 7, line 10, CLAIM 3, Cancel "means" and substitute therefor ---unit---; Col. 7, Line 12, CLAIM 4, Cancel "means" and substitute therefor ---unit---; Col. 8, Line 8, CLAIM 5, Cancel "unit" and substitute therefor ---means---; Col. 8, Line 9, CLAIM 5, Cancel "unit" and substitute therefor ---means---.

Signed and Sealed this

*Twentieth* Day of *November 1984*

[SEAL]

*Attest:*

GERALD J. MOSSINGHOFF

*Attesting Officer*

*Commissioner of Patents and Trademarks*